US007324065B2

(12) United States Patent
Turchinetz et al.

(10) Patent No.: US 7,324,065 B2
(45) Date of Patent: Jan. 29, 2008

(54) ANTENNA RADIATION COLLIMATOR STRUCTURE

(75) Inventors: Beverly Turchinetz, Chelmsford, MA (US); John Derov, Lowell, MA (US); Everett Crisman, Woonsocket, RI (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 136 days.

(21) Appl. No.: 11/340,822

(22) Filed: Jan. 17, 2006

(65) Prior Publication Data

US 2007/0164908 A1 Jul. 19, 2007

(51) Int. Cl.
*H01Q 15/02* (2006.01)

(52) U.S. Cl. ..... 343/909; 343/700 MS

(58) Field of Classification Search ..... 343/909, 343/700 MS

See application file for complete search history.

(56) References Cited

U.S. PATENT DOCUMENTS 5,510,803 A * 4/1996 Ishizaka et al. ..... 343/700 MS
6,208,316 B1 * 3/2001 Cahill ..... 343/909
7,190,325 B2 * 3/2007 Nagy ..... 343/909

* cited by examiner

*Primary Examiner*—Trinh Dinh
*Assistant Examiner*—Dieu Hien T Duong
(74) *Attorney, Agent, or Firm*—AFMCLO/JAZ; Robert V. Klauzinski

(57) ABSTRACT

An antenna radiation collimator structure is provided as including a number of resonator circuit boards oriented to form a block structure. A sheet of dielectric material is disposed between each of the number of resonator circuit boards to maintain a substantially uniform spacing between each of the resonator circuit boards. A plurality of conductive unit resonator cells may be disposed on first planar surfaces of each of the number of resonator circuit boards and a plurality of conductive strip lines may also be disposed on second planar surfaces of each of the number of resonator circuit boards. In this arrangement, radiation applied to a substantially central location of the block structure interacts with the plurality of conductive unit resonator cells and the plurality of conductive strip lines for redirecting the radiation out of front and rear facing surfaces of the block structure as respective first and second substantially collimated beams.

15 Claims, 5 Drawing Sheets

ANTENNA RADIATION COLLIMATOR STRUCTURE

STATEMENT OF GOVERNMENT INTEREST

The invention described herein may be manufactured and used by or for the Government for governmental purposes without the payment of any royalty thereon.

FIELD OF THE INVENTION

The present invention relates generally to antennas and, more particularly, to an antenna structure adapted for transmitting a collimated electromagnetic beam having predetermined beam width.

BACKGROUND OF THE INVENTION

As is known, conventional physically narrow antennas, such as balanced sleeve dipole antennas, transmit omni-directional electromagnetic radiation with substantially uniform intensity in all directions. It is often desirable, however, to focus or provide a collimated radiation beam to a particular target, such as in radar target acquisition and/or searching operations. Conventional structures for receiving and converting the omni-directional radiation beam to a collimated radiation beam generally include convergent lenses, angular filters and guided wave horns.

The use of convergent lenses, angular filters or guided wave horns to convert the omni-directional radiation into a collimated beam, however, provides only a mono-directional beam, that is, a collimated beam transmitted in a single direction. In order to provide a bidirectional beam, the convergent lenses, angular filters or guided wave horns would have to be used in pairs, which may contribute to system costs. Furthermore, there can be a significant loss in signal or beam intensity when using convergent lenses or angular filters to convert from the omni-directional radiation beam provided by the antenna to the collimated radiation beam provided by these devices due to inherent losses that occur during the conversion process. Horns may not be particularly lossy, but they are heavy, and thus using them in portable application is undesirable due to their contribution to system weight.

It would, therefore, be desirable to overcome the aforesaid and other disadvantages.

SUMMARY OF THE INVENTION

In one aspect of the present invention, set forth is an antenna radiation collimator structure. The antenna radiation collimator structure includes a number of resonator circuit boards constructed and arranged to substantially form a block structure. A sheet of dielectric material may be disposed between each of the number of resonator circuit boards, which serves to maintain a substantially uniform spacing between each of the resonator circuit boards. A plurality of conductive unit resonator cells may be disposed on first planar surfaces (e.g., top surfaces) of each of the number of resonator circuit boards. Furthermore, a plurality of conductive strip lines may also be disposed on second planar surfaces (e.g., bottom surfaces) of each of the number of resonator circuit boards. In this arrangement, radiation applied to a substantially central location of the block structure interacts with the plurality of conductive unit resonator cells and the plurality of conductive strip lines for redirecting the radiation out of front and rear facing surfaces of the block structure as respective first and second substantially collimated beams having substantially equal and oppositely directed magnitudes.

In another aspect of the present invention, set forth is an antenna beam steering structure. The antenna beam steering structure includes a number of circuit boards interleaved with a number of dielectric sheet spacers to substantially form a block structure. An array of resonator cells may be disposed on top planar surfaces of each of the number of circuit boards and a number of conductive strip lines may be disposed on bottom planar surfaces of each of the number of circuit boards. A slot may be formed on a central portion of the block structure, which is dimensioned to accept an antenna. The antenna may be inserted into the slot for providing radiation to a substantially central location of the block structure. In this arrangement, the antenna provides radiation to a central region of the block structure and the radiation interacts with the array of resonator cells and the number of conductive strip lines for redirecting the radiation out of front and rear facing surfaces of the block structure as respective first and second substantially collimated beams having substantially equal and oppositely directed magnitudes.

In another aspect of the present invention, set forth is an antenna beam steering structure. The antenna beam steering structure includes a number of circuit boards interleaved with a number of dielectric sheet spacers to substantially form a block structure. An array of resonator cells may be disposed on top planar surfaces of each of the number of circuit boards and a number of conductive strip lines may be disposed on bottom planar surfaces of each of the number of circuit boards. A metallic sheet may be disposed on a rear facing surface of the block structure, which is adapted to reflect radiation towards a front facing surface of the block structure. A slot may be formed on a central portion of the block structure and is dimensioned to accept an antenna. The antenna may be inserted into the slot for providing radiation to a substantially central location of the block structure. In this arrangement, the radiation provided to the central location of the block structure interacts with the array of resonator cells, the number of conductive strip lines and the metallic sheet for redirecting the radiation out of the front facing surface of the block structure as a first substantially collimated beam having a relatively increased beam intensity.

BRIEF DESCRIPTION OF THE DRAWINGS

The invention will be more fully understood from the following detailed description taken in conjunction with the accompanying drawings, in which.

DETAILED DESCRIPTION OF THE INVENTION

The present invention provides an antenna radiation collimator structure. The antenna radiation collimator structure is constructed and arranged for redirecting incident omni-directional radiation, which is transmitted by an antenna, into first and second collimated radiation beams that include a relatively greater beam intensity than the originally transmitted omni-directional radiation. The antenna radiation collimator structure may be employed in a number of applications including applications that require a collimated radiation beam having increased beam intensity or power without increasing the output power or radiation transmission of the antenna. As will be described in further detail below, suffice it to say here, the antenna radiation collimator structure provides a lightweight, compact structure that can be mounted on a conventional omni-directional transmission antenna for converting omni-directional radiation emitted from the antenna into one or more collimated beams having greater beam intensity or power than the originally emitted omni-directional radiation.

Figure 1:
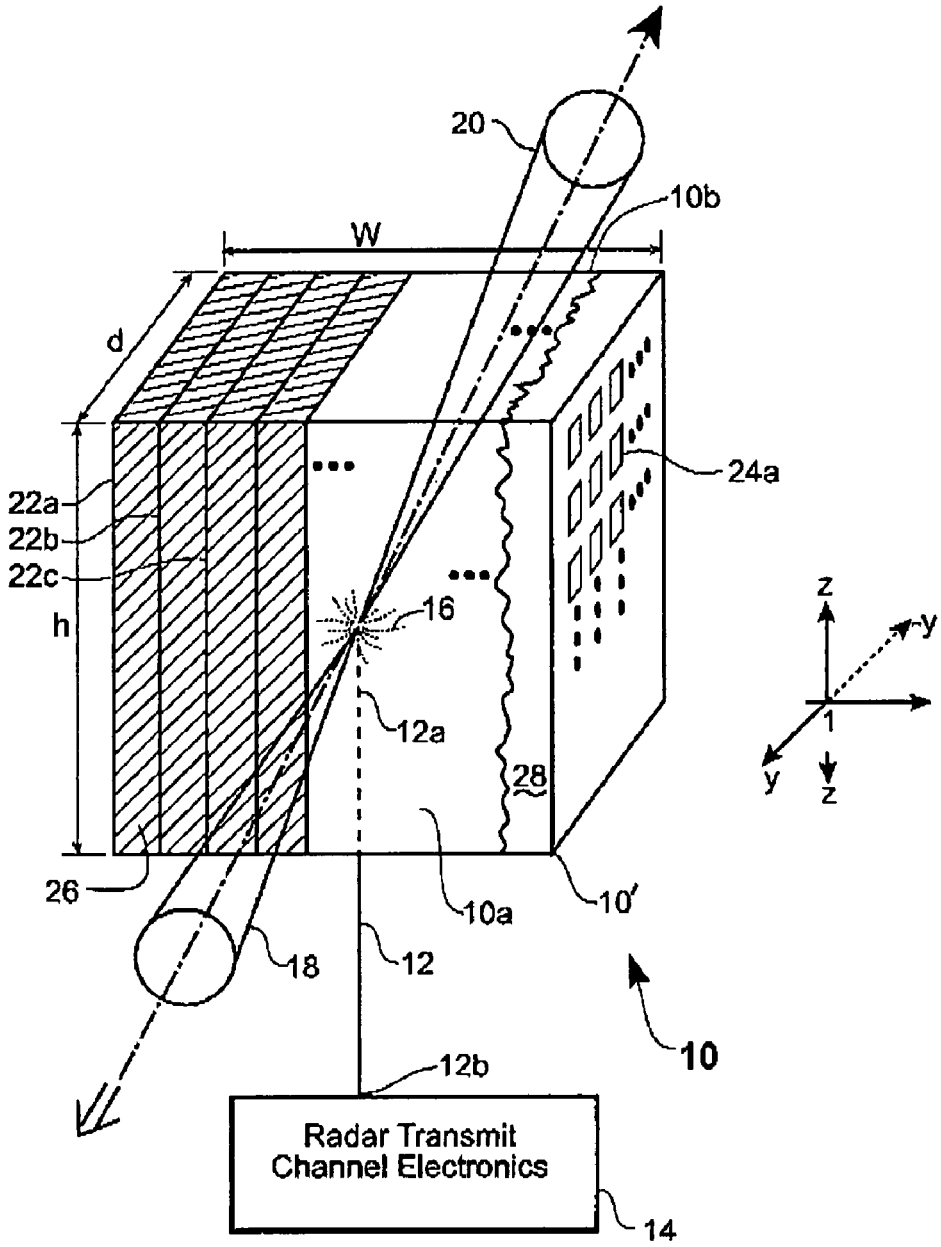
FIG. 1 shows an embodiment of the antenna radiation collimator structure in accordance with the present invention.

Referring now to FIG. 1, shown is one embodiment of the antenna radiation collimator structure 10 in accordance with principles of the present invention. In the illustrative embodiment, the antenna radiation collimator structure 10 is constructed and arranged to be mounted directly on a distal end 12*a* of a conventional transmission antenna 12. An opposite end 12*b* of the transmission antenna 12 may be coupled to conventional radar transmission channel electronics 14, which are operative to drive the transmission antenna 12 for permitting the antenna 12 to emit omni-directional radiation 16 from the distal end 12*a* thereof. As will become apparent from the description below, suffice it to say here that, the antenna radiation collimator structure 10 is adapted to receive and interact with the omni-directional radiation 16 emitted From the distal end 12*a* of the antenna 12 for providing a first collimated radiation beam 18 emitted from a Front face 10*a* of the antenna radiation collimator structure 10 (e.g., along a +y-axis) and a second collimated beam 20 emitted from a back face 10*b* of the antenna radiation collimator structure 10 (e.g., along a -y-axis).

In the exemplary embodiment, the antenna radiation collimator structure 10 includes a number of resonator circuit boards 22*a*, 22*b*, 22*c* (hereinafter collectively referred to as "circuit boards 22") which are constructed and arranged to substantially form a block structure 10' including the front and rear faces 10*a*, 10*b* as described above. The block structure 10' may include a height "h," a depth "d" and a width "w." The circuit boards 22 each include a relatively sturdy but flexible substrate material, such as Kapton, Rogers 5880 substrate or other known substrate materials which are suitable for receiving etched signal traces. As will be described in further detail below, suffice it to say here that each of the circuit boards 22 includes a number of conductive elements or unit resonator cells 24*a* which may be formed using known etching processes. Further, the unit resonator cells 24*a* may include a number of conductive materials or an alloy of the number of conductive materials, which materials may include copper, aluminum, gold and tungsten.

A relatively uniform spacing is maintained between each of the plurality of resonator circuit boards 22 by a sheet of dielectric material 26. Each sheet of dielectric material 26 is interleaved or otherwise disposed between each of the number of resonator circuit boards 22. In an embodiment, each sheet of dielectric material 26 may include any one of a number of materials, which may be selected to be substantially transparent to the circuit boards 22 at microwave frequencies. For example, each sheet of the dielectric material 26 may include a sheet of Eccosorb PP-2 foam or other similarly constructed foam materials. In the exemplary embodiment, each sheet of dielectric material 26 is approximately 0.125 inches in thickness. In other embodiments, a slotted frame may be incorporated into the block structure 10' to retain the resonator circuit boards 22 in alignment and to maintain a substantially uniform air spacing between each of the circuit boards 22.

The antenna radiation collimator structure 10 may be further encapsulated in a dielectric wrapping material 28. The dielectric wrapping material 28 is operative to securely retain the number of resonator circuit boards 22 in predetermined alignment with respect to each other and to maintain the rigidity of the block structure 10' itself. In an embodiment, the dielectric wrapping material 28 may include at least one of plastic shrink wrap, plastic wrap and Top Flight MonoKote.

Figure 2A:
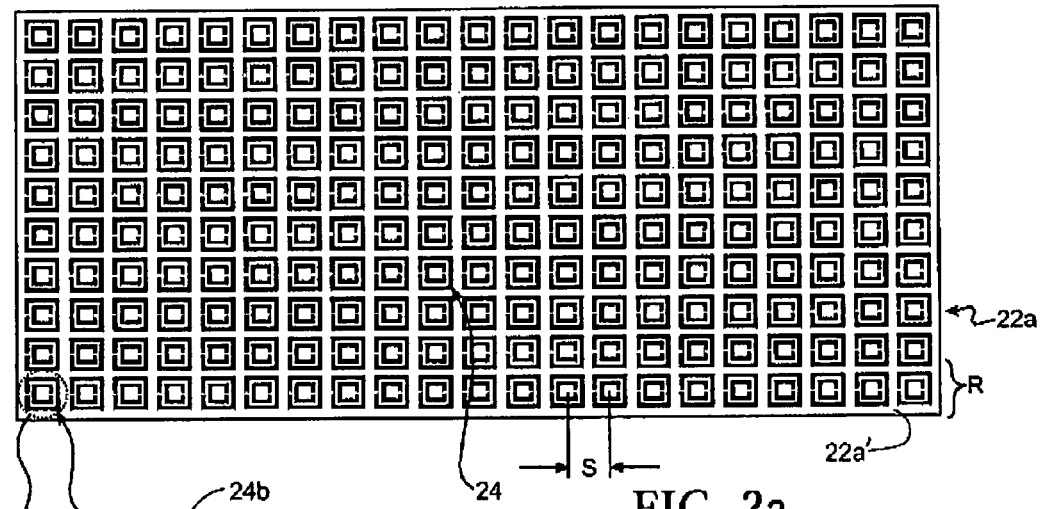
FIG. 2*a* shows an array of conductive unit cells which are disposed on top planar surfaces of each of circuit boards included on the antenna radiation collimator structure of FIG. 1.

FIG. 2*a* shows a plan view of the resonator circuit board 22*a*, which is included in the antenna collimator structure 10 of FIG. 1. It should be understood that the resonator circuit board 22*a* is shown and described below alone to simplify the description and that the remaining circuit boards 22*b*, 22*c* are similarly constructed and arranged. In FIG. 2*a*, the resonator circuit board 22*a*, includes a first or top planar surface 22*a* . The top planar surface 22*a*' of the resonator circuit board 22*a* includes a plurality of conductive unit resonator cells 24, which are uniformly disposed on the top planar surface 22*a*' of the board 22*a* to form an array of conductive unit resonator cells 24 having a predetermined number of rows and a predetermined number of columns. In an embodiment, the array of conductive unit resonator cells 24 includes ten rows and twenty columns. In this particular arrangement, the array of conductive unit resonator cells 24 includes two-hundred individual resonator cells 24*a*. It should be understood that the number of rows and columns, as well as the number of individual unit resonator cells 24*a* are fully scaleable and that the number of rows and columns provided above are intended for exemplary purposes and as a result these figures can be modified without departing from the spirit and scope of the present invention.

Figure 2B:
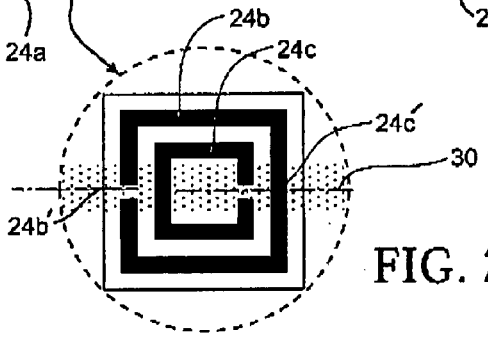
FIG. 2*b* shows an expanded view of one of the conductive unit cells included in the array of conductive unit cells of FIG. 2*a;*

Referring further to FIG. 2*b*, shown is an expanded view of one unit resonator cell 24*a* of the array of unit resonator cells 24 incorporated on the circuit board 22*a* of FIG. 2*a*. In FIG. 2*b*, the unit resonator cell 24*a* may include a pair of concentric split rings 24*b*, 24*c* disposed on the substrate so that gaps 24*b*', 24*c*' associated with each of the respective concentric rings may be oriented approximately 180-degrees with respect to each other. Furthermore, the gaps 24*b*', 24*c*' associated with the respective concentric rings are substantially aligned along a central axis 30, which central axis 30 is also substantially aligned with a corresponding signal trace 40*a* (FIG. 3), of a number of signal traces 40 (FIG. 3) disposed on a second or bottom surface 22*a*" of the circuit board 22*a*, which will be described in further detail below in connection with FIG. 3.

In an embodiment, the unit resonator cells 24*a* of the array of conductive unit resonator cells 24 are spaced approximately 146 mils center to center, as represented by the label "s" (FIG. 2*a*). The outer concentric split ring 24*b* is approximately 106 mils in length on each side. The line width of each of the centric split rings 24*b*, 24*c* is approximately 10 mils, the space between each of the concentric split rings 24*b*, 24*c* is approximately 12 mils and the gaps 24*b*', 24*c*' associated with each of the respective split rings 24*b*, 24*c* are approximately 20 mils across. It should be understood that each of the unit resonator cells 24 are not limited to concentric split ring structures, rather each of the unit resonator cells 24 may include any one of a number of other self resonant structures, such are spirals.

Figure 3:
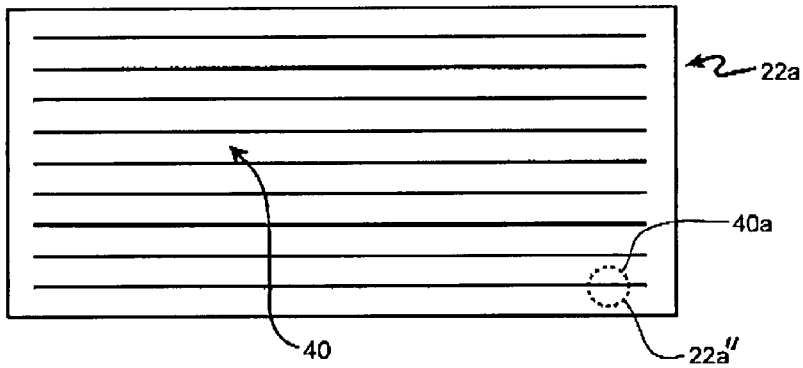
FIG. 3 shows a number of conductive strip lines which are disposed on bottom planar surfaces of each of the circuit boards included on the antenna radiation collimator structure of FIG. 1.

Referring to FIG. 3, as briefly mention above, the resonator circuit board 22*a* further includes a second or bottom planar surface 22*a*". The bottom planar surface 22*a*" of the resonator circuit board 22*a* includes a number of conductive strip lines 40 uniformly disposed to form a number of rows corresponding to the number of rows of unit resonator cells 24 disposed on the first or top surface 22*a*' of the resonator circuit board 22*a*. Moreover, the number of conductive strip lines 40 disposed on the bottom surface 22*a*" of the circuit board 22*a* are substantially centered on and corresponds with a row of unit resonator cells 24*a* disposed on the top surface 22*a*' of the circuit board 22*a*. For example, strip line 40*a*, may be substantially centered on row "R" (FIG. 2*a*) of unit resonator cells 24*a*. In an embodiment, the width of each of the number of strip lines 40 is defined to be substantially centered and slightly wider than the gaps 24*b*', 24*c*' (FIG. 2*b*) associated with the respective concentric split rings 24*b*, 24*c* (FIG. 2*b*). In one specific example, the width of each of the number of strip lines 40 may be approximately 30 mils.

Figure 4:
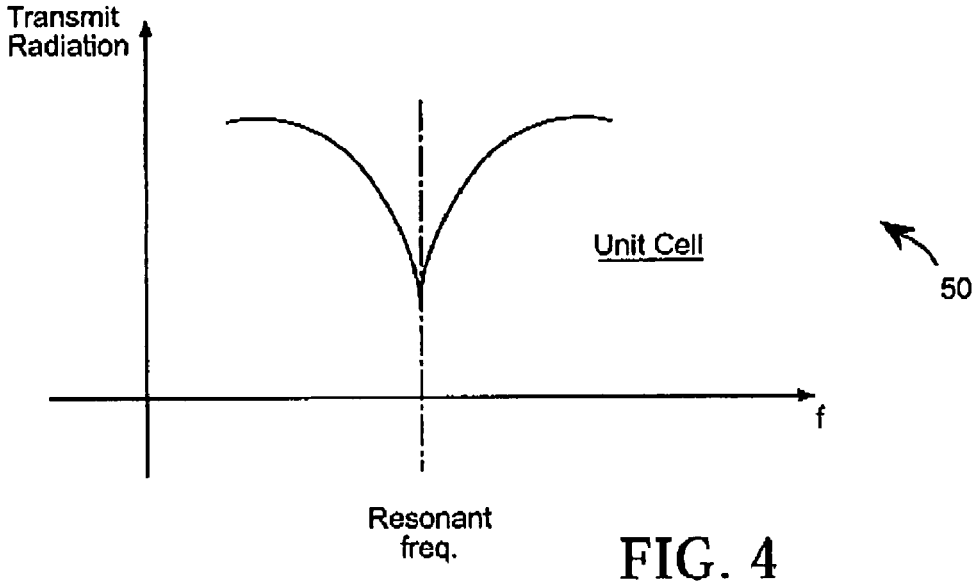
FIG. 4 shows a graph representing instances when each of the conductive unit cells included in the array of unit cells disposed on the top surfaces of each of the circuit boards will pass or reflect electromagnetic radiation.

Referring to FIG. 4, shown is a graph 50 representing one embodiment of the resonant frequency for which each of the unit resonator cells 24*a* included on the array of conductive unit resonator cells 24 (FIG. 2*a*) will resist the transmission of radiation, which is originated from the antenna 12 (FIG. 1), from the top surface 22*a* of the circuit board 22*a* to the bottom surface 22*a*" of the circuit board 22*a*. For example, as can be realized by inspection of the graph 50, at most frequencies radiation is permitted to pass through the circuit board including the array of unit resonator cells 24 formed on the top surface 22*a*' and corresponding number of strip lines 40 located on the bottom surface 22*a*". In other words, at most Frequencies the radiation emitted from the antenna 12 may travel from the top surface 22*a*' of the circuit board 22*a* including the array of unit resonator cells 24 to the bottom surface 22*a*' of the circuit board 22*a* including number of strip lines 40. However, as can also be realized by inspection of the graph 50, at the resonant frequency the radiation is substantially absorbed by the array of unit resonator cells 24 and thus, the radiation emitted at the resonant frequency is not permitted to pass from the top surface 22*a*' of the circuit board 22*a* to the bottom surface 22*a*' of the circuit board 22*a*. In the exemplary embodiment, the resonant frequency is tuned to approximately 13.8 GHz. It should be understood that the operation of the array of unit resonator cells 24 has been described with respect to the circuit board 22*a* and that the arrays of unit resonator cells associated with other circuit boards, such as boards 22*b*, 22*c*, will operate in a similar manner.

Figure 5:
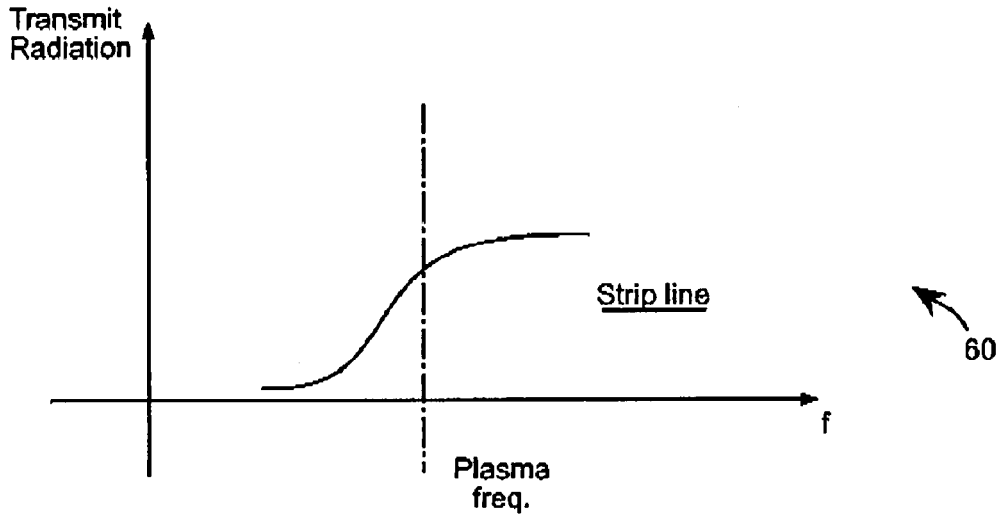
FIG. 5 shows a graph representing instances when each of the strip lines included in the number of strip lines disposed on the bottom surfaces of each of the circuit boards will pass or reflect electromagnetic radiation.

Referring to FIG. 5, shown is a graph 60 representing one embodiment of the plasma frequency for which each strip line 40*a* of the number of rows of strip lines 40 disposed on the bottom surface 22*a*" of the circuit board 22*a* will permit radiation to transmit out from the bottom surface 22*a*" of the circuit board 22*a*. For example, as can be realized by inspection of the graph 60, at most frequencies radiation is permitted to pass from the bottom surface 22*a*" of the circuit board 22*a*, which includes the number of strip lines 40. In other words, at most frequencies the radiation emitted from the antenna 12 may travel from the top surface 22*a*' of the circuit board 22*a*, including the array of unit resonator cells 24, to the bottom surface 22*a*" of the circuit board 22*a*, including the number of strip lines 40, and outwardly from the bottom surface 22*a*" of the circuit board 22*a*. However, as can also be realized by inspection of the graph 60, at or below the plasma frequency the radiation is substantially blocked by the number of rows of strip lines 40 and thus, the radiation emitted at or below the plasma frequency is not permitted to pass from the top surface 22*a*' of the circuit board 22*a* to the bottom surface 22*a*" of the circuit board 22*a* and outwardly as described above with respect to frequencies above the plasma frequency. In the exemplary embodiment, the plasma frequency is tuned to approximately 13.8 GHz. It should be understood that the operation of the number of rows of strip lines 40 has been described with respect to circuit board 22*a* and that the number of strip lines associated with other circuit boards, such as boards 22*b*, 22*c*, will operate in a similar manner.

Accordingly, in electrically aligning the resonant frequency associated with the array of unit cells 24, as graphically represented in FIG. 4, with the plasma frequency associated with the number of rows of strip lines 40, as graphically represented in FIG. 5, the circuit boards 22 may be controlled to reflect the omni-directional radiation 16 originated from the antenna 12 (FIG. 1). Furthermore, the omni-directional radiation 16 may be redirected to be emitted out of front and rear facing surfaces 10*a*, 10*b* of the block structure 10' (FIG. 1) as respective first and second collimated radiation beams 18, 20 (FIG. 1) including equal and oppositely directed magnitudes.

Figure 6:
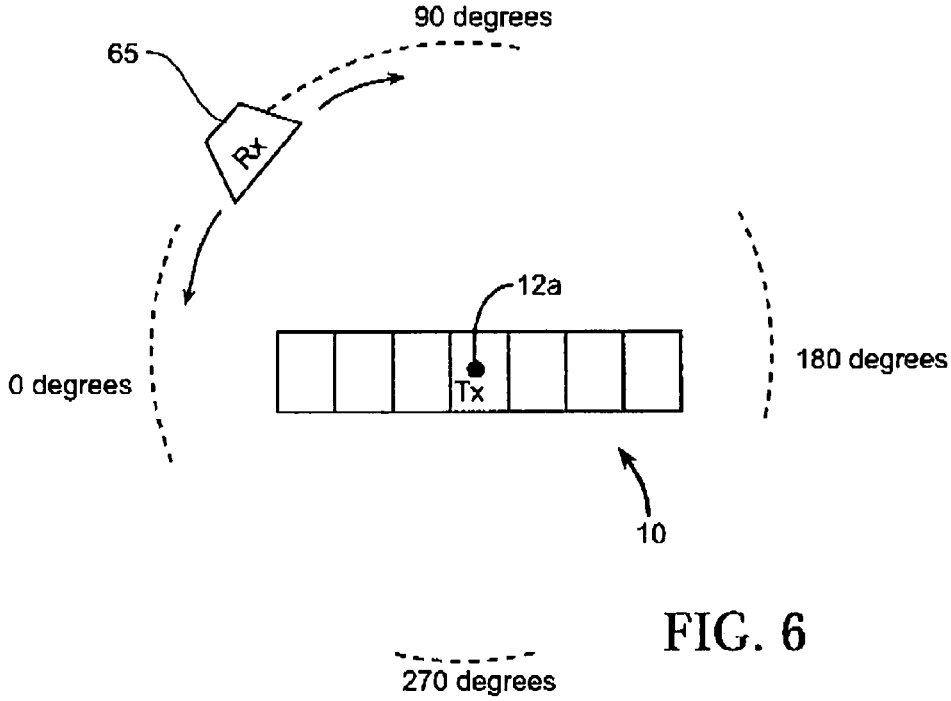
FIGS. 6 and 7 respectively shows an experimental application of the antenna radiation collimator structure and a graph representing results of the experimental application.

FIG. 6 shows an exemplary operation of the antenna radiation collimator structure 10 of the present invention. More specifically, the antenna radiation collimator structure 10 is mounted on the distal end 12*a* of the conventional antenna 12 (FIG. 1), which is controlled to transmit omni-directional radiation over a predetermined range of frequencies. In mounting the antenna radiation collimator structure 10 to the distal end 12*a* of the antenna 12, attention should be paid to inserting the distal end 12*a* of the antenna 12 into a preformed slot defined on the antenna radiation collimator structure 10, which is constructed and arranged to position the distal end 12*a* of the antenna 12 in a substantially central position of the antenna radiation collimator structure 10. For maximum effect, the orientation of the main electric and magnetic fields radiated by the antenna 12 should be oriented so that the electric field is parallel to the number of strip lines 40 which is disposed on each of the circuit boards 22 in the antenna radiation collimator structure, and the magnetic field should be perpendicular to the planes of the circuit boards 22 in the antenna radiation collimator structure 10. The antenna 12 used for the measurements included here is the type known as a balanced sleeve dipole.

A receiver 65 may be slowly rotated about a fixed radius from the antenna 12. In an embodiment, the receiver 65 may include a Hewlett Packard 8510 Network Analyzer or a similarly constructed receiver. Furthermore, the fixed radius for which the receiver 65 is slowly rotated about the antenna 12 is approximately 101 inches. It should be understood that the fixed radius for which the receiver is slowly rotated is provided here as approximately 101 inches for exemplary purposes and that the fixed radius may be adjusted to included other values.

Figure 7:
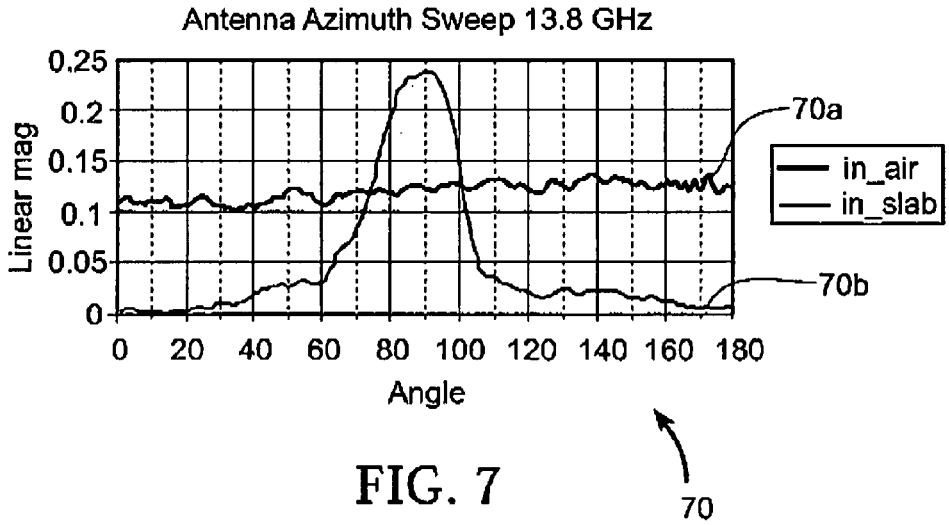

Referring further to FIG. 7, shown is a graph 70 representing a comparative analysis of radiation patterns sensed and displayed by the receiver 65. More particularly, the receiver 65 is first rotated about the fixed radius and controlled to sense and display a first radiation pattern 70*a* representing the antenna radiation pattern without use of the antenna radiation collimator structure 10. As can be determined by inspection of the first radiation pattern 70*a*, the radiation emitted from the antenna 12 appears to have a uniform beam intensity of approximately less than −10 dB at all angles through 180 degrees, which suggests that the antenna 12 is transmitting a well known omni-directional radiation pattern.

Next, the receiver 65 is again rotated about the fixed radius and controlled to sense and display a second radiation pattern 70*b* representing the antenna radiation pattern with the antenna radiation collimator structure 10 mounted on the distal end 12*a* of the antenna 12, as described above. As can be determined by inspection of the second radiation pattern 70*b*, the radiation emitted from the antenna 12 appears to have a Gaussian or collimated beam intensity that is substantially centered at 90-degrees, which shows that the antenna 12 is now transmitting a collimated radiation pattern. Furthermore, inspection of the first and second antenna radiation patterns 70*a*, 70*b* together shows that the collimated beam associated with the second antenna radiation pattern 70*b* includes a significantly increased beam power or intensity level than the intensity level of the omni-directional antenna radiation pattern associated with the first antenna radiation pattern 70*a*. It should be understood, that the receiver may be continued to slowly rotate through a full 360 degrees to provide a third radiation pattern (not shown) having similar characteristics as the second radiation pattern 70*b* but angle shifted to be substantially centered at approximately 270 degrees. In other words, the third radiation pattern includes a substantial mirror image of the second radiation pattern 70*b* and is angle shifted out to be substantially centered at approximately 270 degrees.

Figure 8:
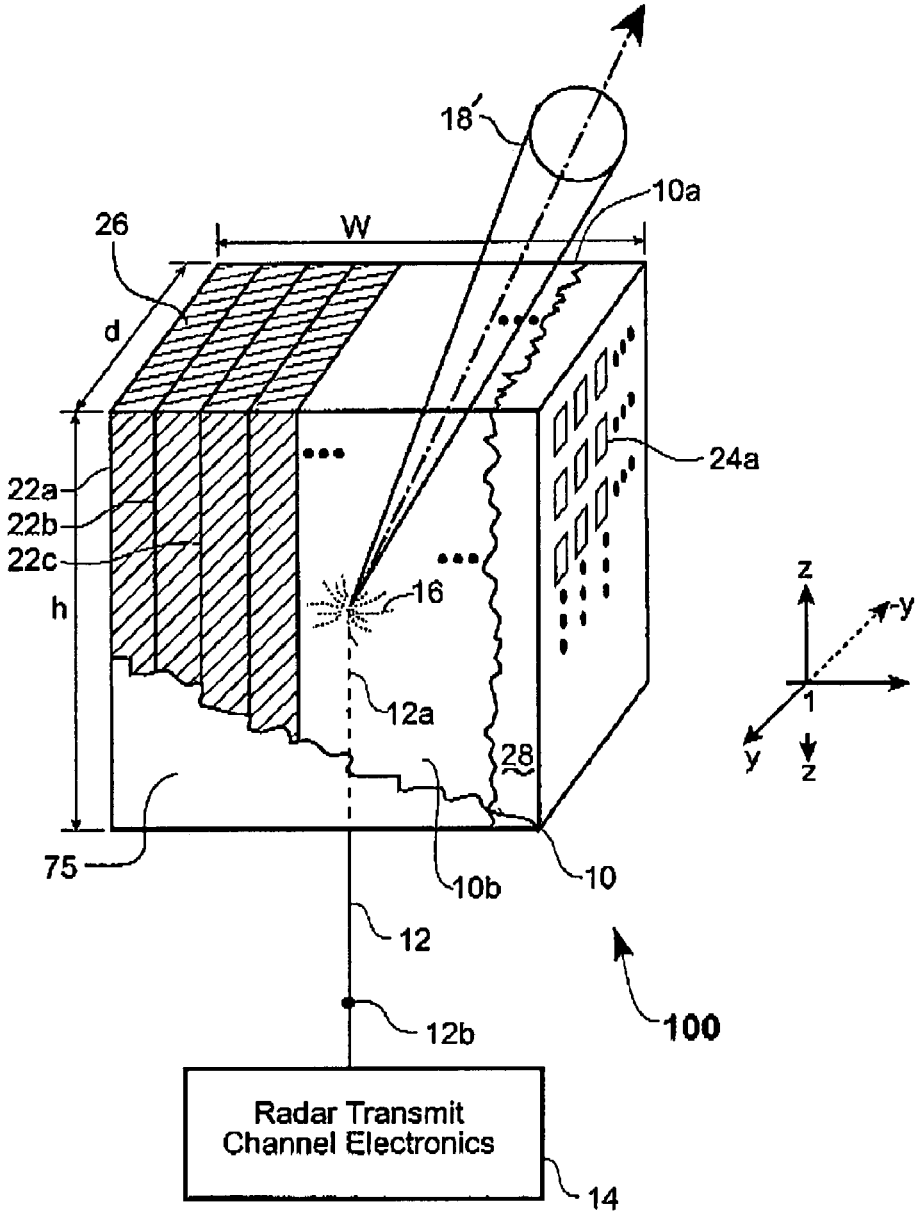
FIG. 8 shows another embodiment of the antenna radiation collimator structure.

Referring to FIG. 8, shown is another embodiment of an antenna radiation collimator structure 100. In the illustrative embodiment, the antenna radiation collimator structure 100 is similarly constructed and arranged as the antenna radiation collimator structure 10 (FIG. 1) and thus similar elements are provided with similar reference designations. In FIG. 8, the antenna radiation collimator structure 100 further includes a metallic sheet 75 which may be mounted to the back face 10*b* of the antenna radiation collimator structure 100. The metallic sheet 75 operates to reflect the second collimated beam 20 (FIG. 1) signal that would have otherwise exited that back face 10*b* of the antenna collimator structure 100. Further the redirected second collimated bean 20 (FIG. 1) is cumulatively combined with the first collimated beam 18' which is emitted from the front face 10*a* of the antenna radiation collimator structure 100. Introducing the metallic sheet 75 to the rear face 10*b* of the antenna radiation collimator structure 100 would also be operative to further increase the apparent gain of the first radiation beam 18' transmitted from the front face 10*a* of the antenna radiation collimator structure 100.

The antenna radiation collimator structure(s) 10, 100 of the present invention provide a relatively lightweight and compact structure compared to previous devices used to provide collimated radiation beams, such as lenses, angular filters and horns. The antenna radiation collimator structure(s) 10, 100 show its effect in a size less than one half a wavelength in thickness and one wavelength wide. Further, the amplitudes of the first and second radiation patterns (FIG. 7) or first and second beams (FIG. 1), propagating in the two preferred directions, is greater than the amplitude of the original omni-directional signal provided by the transmission antenna. This means the antenna radiation collimator structure shows gain in the preferred directions, rather than loss, as with previous devices. Also, the signal at right angles to the preferred directions is greatly reduced. This effect would reduce mutual interference between two signal sources spaced close together, even as close as one half wavelength spacing.

One skilled in the art will appreciate further features and advantages of the invention based on the above-described embodiments. Accordingly, the invention is not to be limited by what has been particularly shown and described, except as indicated by the appended claims. All publications and references cited herein are expressly incorporated herein by reference in their entirety.

What is claimed is:

1. An antenna radiation collimator structure, comprising:

a number of resonator circuit boards constructed and arranged to substantially form a block structure;

a sheet of dielectric material disposed between each of the number of resonator circuit boards and being operative to maintain a substantially uniform spacing between each of the resonator circuit boards;

a plurality of conductive unit resonator cells disposed on first planar surfaces of each of the number of resonator circuit boards; and a plurality of conductive strip lines disposed on second planar surfaces of each of the number of resonator circuit boards, wherein radiation applied to a substantially central location of the block structure interacts with the plurality of conductive unit resonator cells and the plurality of conductive strip lines for redirecting the radiation out of front and rear facing surfaces of the block structure as respective first and second substantially collimated beams having substantially equal and oppositely directed magnitudes.

2. The antenna radiation collimator structure of claim 1, further including a dielectric wrapping material disposed on exterior surfaces of the block structure and being operative to securely retain the number of resonator circuit boards in predetermined alignment.

3. The antenna radiation collimator structure of claim 2, wherein the dielectric wrapping material includes at least one of plastic shrink wrap and plastic wrap.

4. The antenna radiation collimator structure of claim 1, wherein the plurality of conductive unit resonator cells are disposed on the first planar surfaces of each of the number of resonator circuit boards to form an array of conductive unit resonator cells having a predetermined number of rows and a predetermined number of columns.

5. The antenna radiation collimator structure of claim 4, wherein the array of conductive unit resonator cells includes approximately six cells to approximately sixty nine cells in each of the predetermined number of rows.

6. The antenna radiation collimator structure of claim 5, wherein the array of conductive unit resonator cells includes approximately three to approximately sixteen cells in each of the predetermined number of columns.

7. The antenna radiation collimator structure of claim 1, wherein each unit cell of the plurality of conductive unit resonator cells includes a pair of concentric split ring structures.

8. The antenna radiation collimator structure claim 1, wherein the plurality of conductive unit resonator cells are disposed on the first planar surfaces of each of the number of resonator circuit boards to include a spacing of approximately 146 millimeters center to center.

9. The antenna radiation collimator structure of claim 1, wherein each unit cell of the plurality of conductive unit resonator cells includes an outer split ring and an inner split ring.

10. The antenna radiation collimator structure of claim 9, wherein the sheet of dielectric material disposed between each of the number of resonator circuit boards includes at least one of foam and air.

11. The antenna radiation collimator structure of claim 9, wherein the outer split ring includes a first gap and the inner split ring includes a second gap whereby the first and second gaps are oriented approximately 180-degrees with respect to each other.

12. The antenna radiation collimator structure of claim 1, wherein the plurality of conductive unit resonator cells include at least one of copper, aluminum, gold and tungsten.

13. The antenna radiation collimator structure of claim 1, wherein the sheet of dielectric material disposed between each of the number of resonator circuit boards includes a material selected to be substantially transparent at microwave frequencies.

14. An antenna beam steering structure, comprising:

a number of circuit boards interleaved with a number of dielectric sheet spacers to substantially form a block structure;

an array of resonator cells disposed on top planar surfaces of each of the number of circuit boards;

a number of conductive strip lines disposed on bottom planar surfaces of each of the number of circuit boards; and a slot formed on a central portion of the block structure and being dimensioned to accept an antenna, wherein the antenna is inserted into the slot for providing radiation to a substantially central location of the block structure and wherein the radiation interacts with the array of resonator cells and the number of conductive strip lines for redirecting the radiation out of front and rear facing surfaces of the block structure as respective first and second substantially collimated beams having substantially equal and oppositely directed magnitudes.

15. An antenna beam steering structure, comprising:

a number of circuit boards interleaved with a number of dielectric sheet spacers to substantially form a block structure;

an array of resonator cells disposed on top planar surfaces of each of the number of circuit boards;

a number of conductive strip lines disposed on bottom planar surfaces of each of the number of circuit boards;

a metallic sheet disposed on a rear facing surface of the block structure and being adapted to reflect radiation towards a front facing surface of the block structure;

a slot formed on a central portion of the block structure and being dimensioned to accept an antenna, wherein the antenna is inserted into the slot for providing radiation to a substantially central location of the block structure and wherein the radiation interacts with the array of resonator cells, the number of conductive strip lines and the metallic sheet for redirecting the radiation out of the front facing surface of the block structure as a first substantially collimated beams having a relatively increased beam intensity.

* * * * *